US009759069B2

(12) United States Patent
Nita et al.

(10) Patent No.: US 9,759,069 B2
(45) Date of Patent: Sep. 12, 2017

(54) TURBINE BLADE

(71) Applicant: IHI Corporation, Tokyo (JP)

(72) Inventors: Kozo Nita, Tokyo (JP); Yoji Okita, Tokyo (JP); Chiyuki Nakamata, Tokyo (JP); Kazuo Yonekura, Tokyo (JP); Seiji Kubo, Tokyo (JP); Osamu Watanabe, Tokyo (JP)

(73) Assignee: IHI CORPORATION (JP)

( * ) Notice: Subject to any disclaimer, the term of this patent is extended or adjusted under 35 U.S.C. 154(b) by 378 days.

(21) Appl. No.: 14/291,104

(22) Filed: May 30, 2014

(65) Prior Publication Data

US 2014/0271229 A1 Sep. 18, 2014

Related U.S. Application Data

(63) Continuation of application No. PCT/JP2012/082572, filed on Dec. 14, 2012.

(30) Foreign Application Priority Data

Dec. 15, 2011 (JP) ..... 2011-274335

(51) Int. Cl.
*F01D 5/18* (2006.01)
*F01D 9/06* (2006.01)

(52) U.S. Cl.
CPC ..... *F01D 5/18* (2013.01); *F01D 5/186* (2013.01); *F01D 9/065* (2013.01);
(Continued)

(58) Field of Classification Search
CPC . F01D 5/18; F01D 5/186; F01D 9/065; F05D 2250/291; F05D 2260/202;
(Continued)

(56) References Cited

U.S. PATENT DOCUMENTS 4,738,588 A * 4/1988 Field ..... F01D 5/186 415/115
6,092,982 A 7/2000 Ikeda et al.
(Continued)

FOREIGN PATENT DOCUMENTS

DE WO 2011118131 A1 * 9/2011 ..... F01D 5/186
JP 06-093802 4/1994
(Continued)

OTHER PUBLICATIONS

International Search Report and Written Opinion mailed Feb. 26, 2013 in corresponding PCT International Application No. PCT/JP2012/082572.

*Primary Examiner* — Marina Tietjen
(74) *Attorney, Agent, or Firm* — Ostrolenk Faber LLP

(57) ABSTRACT

The present invention is a turbine blade (1) having a hollow blade body (2). This turbine blade (1) is provided with: cooling air holes (5) that penetrate the blade body (2) from an internal wall surface (2*e*) to an external wall surface (2*f*) thereof, and are provided with a straight tube portion (5*a*) that is located on the internal wall surface (2*e*) side of the blade body (2), and an expanded diameter portion (5*b*) that is located on the external wall surface (2*f*) side of the blade body (2); and with a guide groove (6) that is located on an internal wall of the expanded diameter portion (5*b*) and that guides cooling air (Y) in the expanded diameter portion (5).

4 Claims, 7 Drawing Sheets

(52) U.S. Cl.
CPC .. *F05D 2250/294* (2013.01); *F05D 2250/324* (2013.01); *F05D 2260/202* (2013.01); *F23R 2900/03041* (2013.01); *F23R 2900/03043* (2013.01)

(58) Field of Classification Search
CPC ..... F05D 2250/324; F12R 2900/03043; F12R 2900/03041
USPC ..... 416/97 R
See application file for complete search history.

(56) References Cited

U.S. PATENT DOCUMENTS 6,176,676 B1 1/2001 Ikeda et al.
6,307,175 B1 * 10/2001 Blochlinger ..... B23K 26/388 219/121.71
6,817,833 B2 * 11/2004 Haselbach ..... F01D 5/186 416/97 R
7,997,867 B1 8/2011 Shih et al. ..... 416/97 R
7,997,868 B1 * 8/2011 Liang ..... F01D 5/186 416/97 R
8,057,181 B1 * 11/2011 Liang ..... F01D 5/186 416/97 R
2005/0286998 A1 * 12/2005 Lee ..... B23K 26/384 415/117
2008/0003096 A1 * 1/2008 Kohli ..... F01D 5/186 415/115
2008/0286090 A1 * 11/2008 Okita ..... F01D 5/186 415/115
2010/0068068 A1 * 3/2010 Liang ..... F01D 5/186 416/97 R
2011/0097191 A1 * 4/2011 Bunker ..... F01D 5/186 415/115
2011/0293423 A1 * 12/2011 Bunker ..... F01D 5/186 416/95
2011/0305583 A1 * 12/2011 Lee ..... F01D 5/18 416/97 R
2012/0167389 A1 * 7/2012 Lacy ..... B23P 6/002 29/889.1
2013/0115103 A1 * 5/2013 Dutta ..... F01D 5/186 416/97 R

FOREIGN PATENT DOCUMENTS

JP A-10-054203 2/1998
JP 10-089005 4/1998
JP 3997986 10/2007
JP 2008-248733 10/2008
JP 2009-162224 7/2009
JP 4752841 8/2011
JP 2011-196360 10/2011
JP 2011-247248 12/2011

* cited by examiner

TURBINE BLADE

CROSS-REFERENCE TO RELATED APPLICATIONS

This application is a continuation of International Application No. PCT/JP2012/082572, filed Dec. 14, 2012, claiming priority to Japanese Patent Application No. 2011-274335, filed Dec. 15, 2011, the contents of both of which are incorporated herein by reference in their entity.

TECHNICAL FIELD

The present invention relates to a turbine blade.

TECHNICAL BACKGROUND

Turbine blades that are provided in gas turbine engines and the like are exposed to combustion gas created by a combustion chamber, and reach extremely high temperatures. Because of this, in order to improve the heat resistance of the turbine blades, various measures such as those disclosed, for example, in Patent documents 1 to 4 have been implemented.

DOCUMENTS OF THE PRIOR ART

Patent Documents

[Patent document 1] Japanese Patent No. 3997986
[Patent document 2] Japanese Patent No. 4752841
[Patent document 3] Japanese Unexamined Patent Application, First Publication No. 10-89005
[Patent document 4] Japanese Unexamined Patent Application, First Publication No. 6-093802

DISCLOSURE OF THE INVENTION

Problems to be Solved by the Invention

However, in recent years, even greater improvements in the output of gas turbine engines and the like have been sought. As a result of this, there has been a trend for the temperature of the combustion gas generated in the combustion chamber to become even hotter than it has previously been.

Because of this, even further improvements in the cooling effectiveness of the turbine blades provided in a gas turbine engine and the like are sought.

The present invention was conceived in view of the above-described circumstances, and it is an object thereof to further improve the cooling effectiveness of turbine blades provided in a gas turbine engine and the like.

Means for Solving the Problem

The present invention employs the following structure as a means of solving the above-described problem.

A first aspect of the present invention is a turbine blade that is provided with a hollow blade body. This turbine blade is provided with: cooling air holes that penetrate the blade body from an internal wall surface to an external wall surface thereof, and are provided with a straight tube portion that is located on the internal wall surface side of the blade body, and an expanded diameter portion that is located on the external wall surface side of the blade body; and with a guide groove that is located on an internal wall of the expanded diameter portion and that guides cooling air in the expanded diameter portion.

A second aspect of the present invention is the turbine blade according to the above-described first aspect, wherein the guide groove is provided extending along an internal wall surface of the expanded diameter portion.

A third aspect of the present invention is the turbine blade according to the above-described first or second aspects, wherein the guide groove is provided extending in the flow direction of the cooling air flowing through the straight tube portion.

A fourth aspect of the present invention is the turbine blade according to any of the above-described first through third aspects, wherein the guide groove has a collision surface that is provided in the expanded diameter portion and intersects the flow direction of the cooling air.

Effects of the Invention

According to the present invention, cooling air holes are provided with an expanded diameter portion that is located in an external wall surface of a blade body. Because of this, cooling air that has flowed into a straight tube portion spreads out in the expanded diameter portion. As a consequence, according to the cooling air holes of the present invention, cooling air can be blown over a wider range, and a greater range of the external wall surface of the blade body can be cooled compared to when the cooling air holes are formed solely by a straight tube portion.

However, it is not possible for the cooling air to flow over a sufficiently wide area simply by providing the expanded diameter portion in the cooling air holes. The reason for this is thought to be that, when the flow direction of the cooling air changes in the expanded diameter portion, the cooling air moves away from the internal wall surfaces of the cooling air holes, and it becomes difficult for the cooling air to flow in areas adjacent to these internal wall surfaces. In this way, simply by providing the expanded diameter portion in the cooling air holes, unevenness is generated in the flow of cooling air, so that in some cases an adequate quantity of cooling air does not flow in the desired direction.

In contrast to this, the present invention is provided with guide grooves that are provided in an internal wall of the expanded diameter portions, and that guide the cooling air in the expanded diameter portions. Because of this, it is possible to guide a portion of the cooling air that flows from the straight tube portion into the expanded diameter portion in the desired direction by means of the guide grooves. Accordingly, according to the present invention, it is possible for the cooling air to spread reliably over a broader range.

In this manner, according to the present invention, it is possible to blow cooling air reliably from the cooling air holes over a broad range, and to cool a broader range of the external wall surfaces of a blade body. As a result, according to the present invention, it is possible to further improve the cooling effectiveness of a turbine blade.

BEST EMBODIMENTS FOR IMPLEMENTING THE INVENTION

Hereinafter, respective embodiments of a turbine blade according to the present invention will be described with reference made to the drawings. Note that in the following drawings, in order to make each component a recognizable size, the scale of each component has been suitably altered.

First Embodiment

Figure 1:
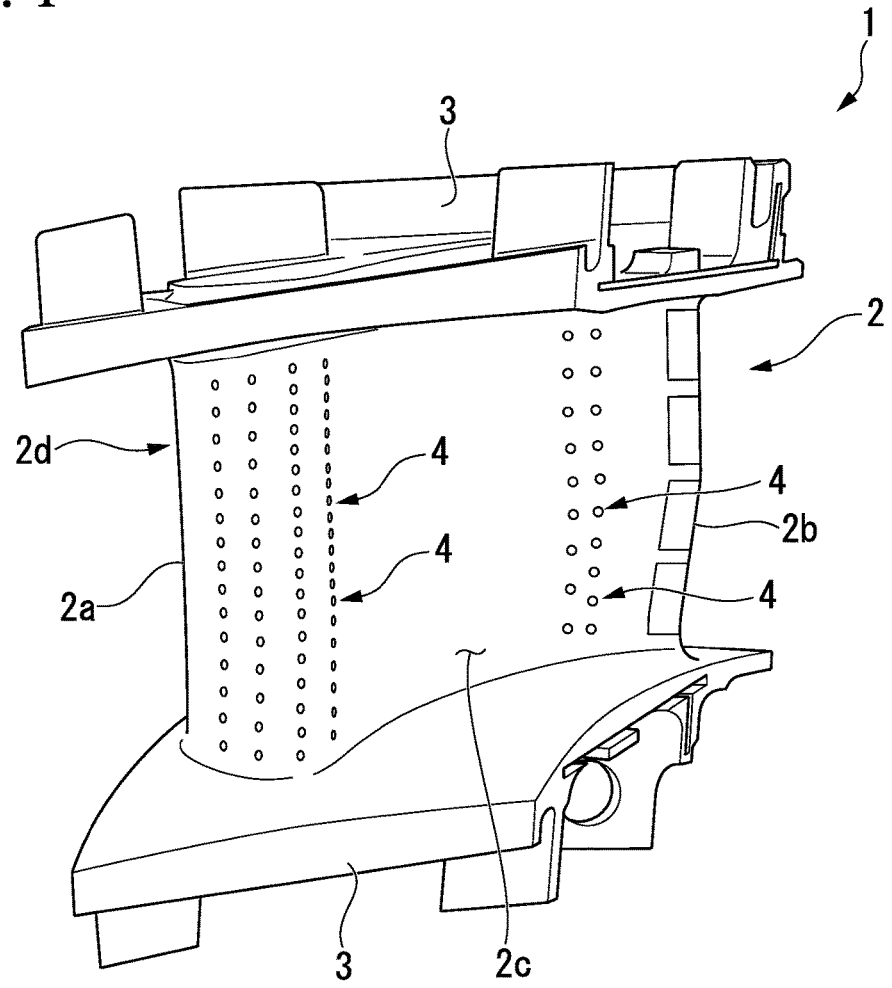
FIG. 1 is a perspective view showing the schematic structure of a turbine blade according to a first embodiment of the present invention.

FIG. 1 is a perspective view showing the schematic structure of a turbine blade 1 of the present embodiment. The turbine blade 1 of the present embodiment is a stationary turbine blade and is provided with a blade body 2, band portions 3 that sandwich the blade body 2, and film cooling portions 4.

The blade body 2 is located on the downstream side of a combustion chamber (not shown), and is located on the flow path of combustion gas G (see FIG. 2B) generated by the combustion chamber. This blade body 2 is provided with a blade shape that has a front edge 2*a*, a rear edge 2*b*, a positive pressure surface 2*c* and a negative pressure surface 2*d*. The blade body 2 is hollow and has an internal space that is used to introduce cooling air into the interior of the blade body 2. A cooling air flow path (not shown) is connected to the internal space in the blade body 2. For example, air extracted from a compressor located on the upstream side of the combustion chamber is introduced as cooling air into this cooling air flow path (not shown). The band portions 3 are provided so as to sandwich the blade body 2 from both sides in the height direction thereof, and function as a portion of the flow path walls of the combustion gas G These band portions 3 are formed integrally with the tip and hub of the blade body 2.

Figure 2A:
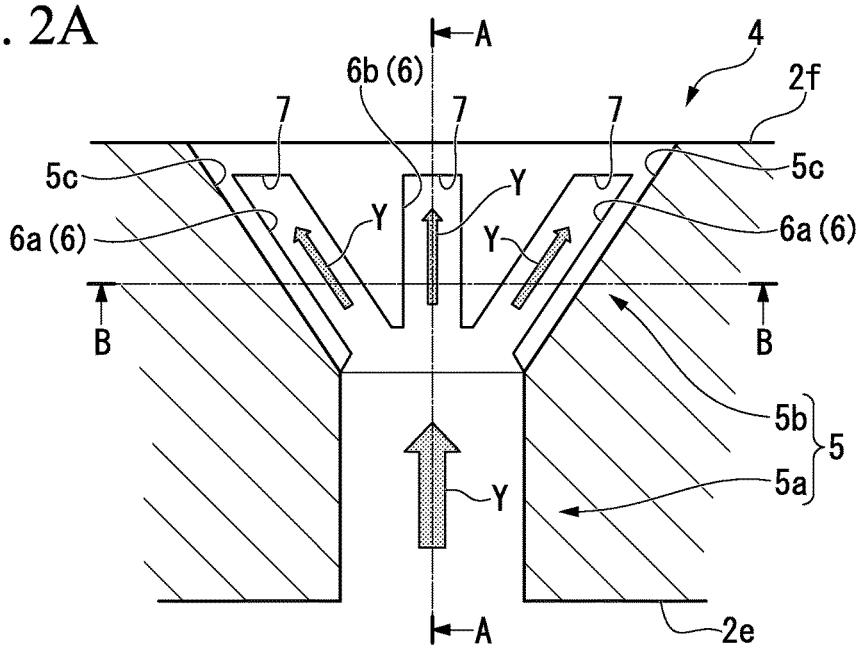
FIG. 2A is a schematic view of film cooling portions provided in the turbine blade according to the first embodiment of the present invention, and is a cross-sectional view taken along a plane that is parallel with the flow direction of cooling air.
Figure 2B:
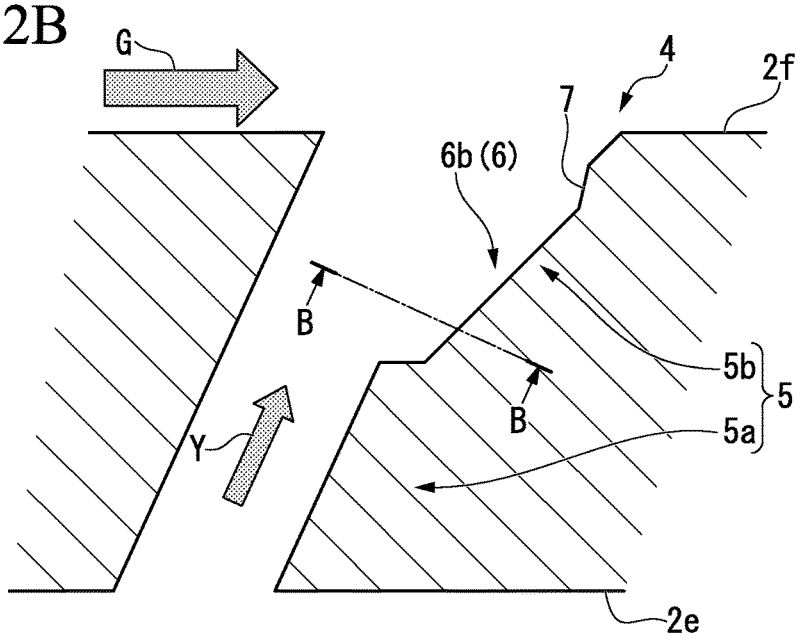
FIG. 2B is a schematic view of the film cooling portions provided in the turbine blade according to the first embodiment of the present invention, and is a cross-sectional view taken along a line A-A in FIG. 2A.
Figure 2C:
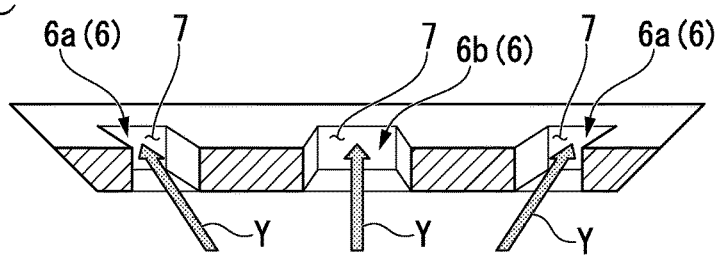
FIG. 2C is a schematic view of the film cooling portions provided in the turbine blade according to the first embodiment of the present invention, and is a cross-sectional view taken along a line B-B in FIG. 2A.

FIGS. 2A through 2C are schematic views of a film cooling portion 4. FIG. 2A is a cross-sectional view taken along a plane that is parallel with the flow direction of cooling air Y, FIG. 2B is a cross-sectional view taken along a line A-A in FIG. 2A, and FIG. 2C is a cross-sectional view taken along a line B-B in FIG. 2A. As is shown in FIGS. 2A through 2C, the film cooling portions 4 are provided with cooling air holes 5, and guide grooves 6.

The cooling air holes 5 are through holes that penetrate the blade body 2 from an internal wall surface 2*e* to an external wall surface 2*f* thereof, and are provided with a straight tube portion 5*a* that is positioned on the internal wall surface 2*e* side, and an expanded diameter portion 5*b* that is positioned on the external wall surface 2*f* side. The straight tube portion 5*a* is a portion that extends in a straight line, and has a cross-section in the shape of an elongated hole. Moreover, the straight tube portion 5*a* is inclined such that an end portion thereof that is positioned on the external wall surface 2*f* side is located further downstream from the main flow gas G that flows along the external wall surface 2*f* of the blade body 2 than the end portion thereof that is positioned on the internal wall surface 2*e* side. The expanded diameter portion 5*b* is a portion where a cross-section of the flow path becomes larger as it moves towards the external wall surface 2*f*. Note that, as is shown in FIG. 2A, the expanded diameter portion 5*b* is shaped such that side wall surfaces 5*c* become larger in the height direction of the blade body 2 as they move from the internal wall surface 2*e* side towards the external wall surface 2*f* side.

This cooling air holes 5 guide the cooling air Y that is supplied from the internal space inside the blade body 2 towards the external wall surface 2*f*, and after having dispersed the cooling air Y such that it spreads in the height direction of the blade body 2, they blow this cooling air Y along the external wall surface 2*f*.

The guide grooves 6 are grooves that are provided in a portion of the inner wall of the expanded diameter portion 5*b* that is positioned on the downstream side of the main flow gas G The guide grooves 6 enlarge localized portions of the flow path surface area of the cooling air holes 5, and a greater quantity of the cooling air Y can be guided in those portions where the guide grooves 6 are formed.

In the present embodiment, the guide grooves 6 are formed by two side guide grooves 6*a* that extend along the side wall surfaces 5*c* of the expanded diameter portion 5*b*, and a center guide groove 6*b* that is located between the side guide grooves 6*a* and that extends in the flow direction of the cooling air Y that flows along the straight tube portion 5*a*.

Moreover, a collision surface 7 that is orthogonal to (i.e., that intersects) the flow of the cooling air Y is provided at the end portion on the external wall surface 2*f* side of each guide groove 6. The collision surfaces 7 have the function of obstructing the flow of the cooling air Y so as to increase the pressure loss, and cause the flow speed of the cooling gas Y that strikes the collision surfaces 7 to decrease.

Note that, as is shown in FIG. 1, a plurality of film cooling portions 4 having the above-described structure are provided in the turbine blade 1 of the present embodiment. The cooling gas Y that is expelled from the film cooling portions 4 flows along the external wall surface 2*f* of the blade body 2 and, as a result of this, the external wall surface 2*f* of the blade body 2 is film-cooled.

According to the turbine blade 1 of the present embodiment that has the above-described structure, cooling air from inside the blade body 2 flows into the cooling air holes 5 in the film cooling portions 4. The cooling air Y that flows into the cooling air holes 5 is guided in a straight line in the straight tube portion 5*a* where there is no change in the area of the flow path, and spreads out in the height direction of the blade body 2 as it flows into the expanded diameter portion 5*b* where there is a continuous increase in the area of the flow path. Accordingly, according to the cooling air holes 5 that are provided in the turbine blade 1 of the present embodiment, in contrast to a cooling air hole that is formed solely by a straight tube portion, the cooling air Y can be blown over a wider range in the height direction of the blade body 2 so that the external wall surface 2*f* of the blade body 2 can be cooled over a wider range.

Moreover, in the turbine blade 1 of the present embodiment, the side guide grooves 6*a* are provided extending along the side wall surfaces 5*c* of the expanded portion 5*b*. Because of this, it is possible for a portion of the cooling air Y that flows from the straight tube portion 5*a* into the expanded diameter portion 5*b* to be guided along the side wall surfaces 5*c* by the side guide grooves 6*a*. If the side guide grooves 6*a* are not provided, then it is easy for the cooling air Y to move away from the side wall surfaces 5*c*, so that it becomes difficult for the cooling air Y to flow in areas peripheral to the side wall surfaces 5*c* and the spread of the cooling air Y is inadequate. In contrast to this, according to the turbine blade 1 of the present embodiment, because the cooling air Y is guided along the side wall surfaces 5*c*, the cooling air Y can be made to spread more reliably over a wide range.

Note that by providing the side guide grooves 6*a*, the quantity of cooling air Y that flows along the side wall surfaces 5*c* is increased, and there is a possibility that the quantity of cooling air Y in the center of the expanded diameter portion 5*b* will become less than the quantity of cooling air Y that flows along the side wall portions 5*c*. In order to prevent this, the turbine blade 1 of the present embodiment is provided with the center guide groove 6*b* that is located between the side guide grooves 6*a* and extends in the flow direction of the cooling gas Y that is flowing along the straight tube portion 5*a*. Because of this, in the turbine blade 1 of the present embodiment, cooling air Y is also guided into the center of the expanded diameter portion 5*b*, and it is possible to prevent the quantity of cooling air Yin the center of the expanded diameter portion 5*b* from dropping to less than the quantity of cooling air Y that is flowing along the side wall surfaces 5*c*. As a consequence, according to the turbine blade 1 of the present embodiment, it is possible to evenly distribute the quantity of cooling air Y that is expelled from the cooling air holes 5, and it is possible to evenly cool the external wall surface 2*f* of the blade body 2.

In this manner, according to the turbine blade 1 of the present embodiment, it is possible to reliably blow cooling air Y from the cooling air holes 5 over a wide range, so that it is possible to cool an even greater range of the external wall surface 2*f* of the blade body 2. As a result, according to the turbine blade 1 of the present invention, it is possible to further improve the cooling effectiveness of the turbine blade 1.

Moreover, according to the turbine blade 1 of the present embodiment, the collision surfaces 7 that are orthogonal to (i.e., that intersect) the flow of the cooling air Y are provided at the end portion on the external wall surface 2*f* side of each guide groove 6. Because of this, the cooling air Y flowing along the guide grooves 6 collides with the collision surfaces 7 so that the flow speed thereof is reduced. As a consequence, the cooling air Y can be spread more widely.

Figure 3A:
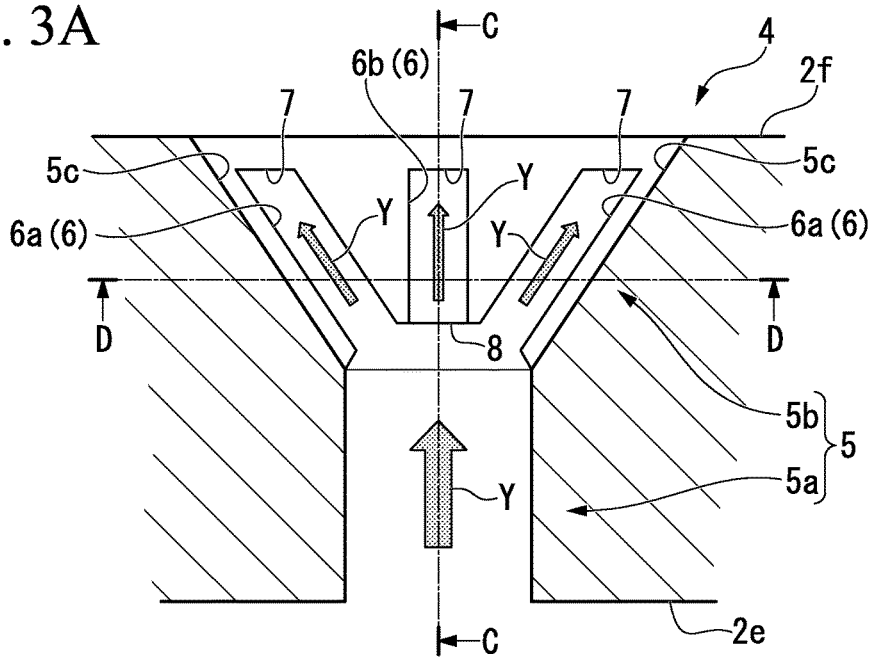
FIG. 3A is a schematic view of a variant example of the film cooling portions provided in the turbine blade according to the first embodiment of the present invention, and is a cross-sectional view taken along a plane that is parallel with the flow direction of cooling air Y.
Figure 3B:
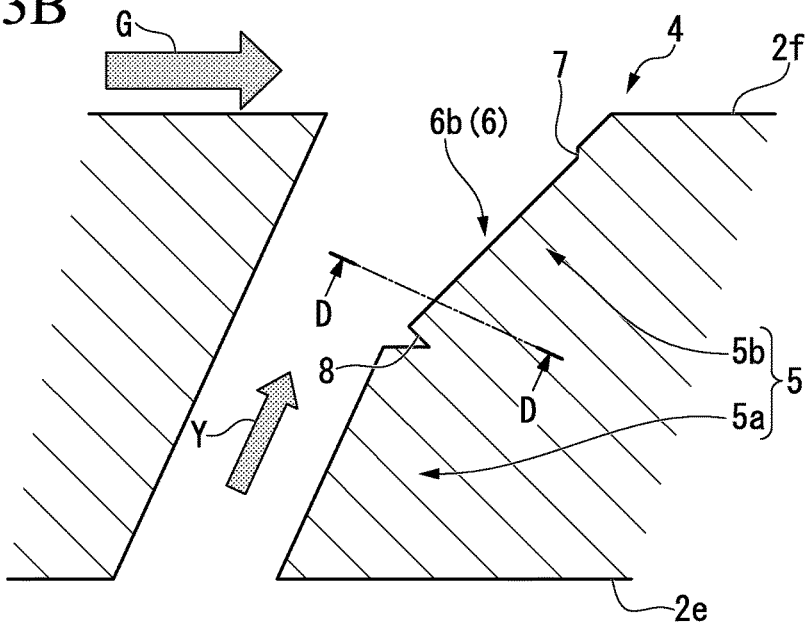
FIG. 3B is a schematic view of the variant example of the film cooling portions provided in the turbine blade according to the first embodiment of the present invention, and is a cross-sectional view taken along a line C-C in FIG. 3A.
Figure 3C:
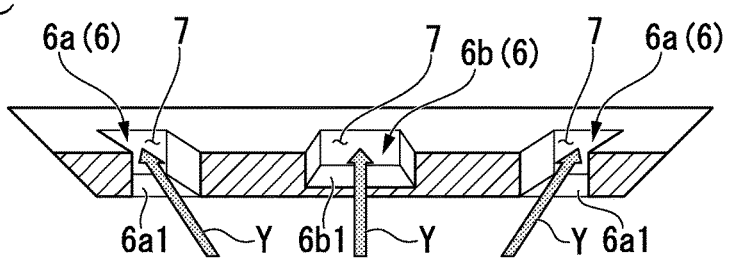
FIG. 3C is a schematic view of the variant example of the film cooling portions provided in the turbine blade according to the first embodiment of the present invention, and is a cross-sectional view taken along a line D-D in FIG. 3A.

FIGS. 3A through 3C are schematic views of a variant example of the film cooling portions 4 that are provided in the turbine blade 1 of the present embodiment. FIG. 3A is a cross-sectional view taken along a plane that is parallel with the flow direction of the cooling air Y, FIG. 3B is a cross-sectional view taken along a line C-C in FIG. 3A, and FIG. 3C is a cross-sectional view taken along a line D-D in FIG. 3A. As is shown in FIGS. 3A through 3C, it is also possible to employ structure in which a floor portion 6*b*1 of the center guide groove 6*b* is higher than a floor portion 6*a*1 of the side guide grooves 6*a*, and a collision surface 8 is also provided on the internal wall surface 2*e* side of the center guide groove 6*b*. By providing the collision surface 8, it is possible to reduce the flow speed of the cooling air Y at the entrance of the expanded diameter portion 5*b* as well, so that the cooling air Y can be blown even more reliably over a wide range.

Figure 4A:
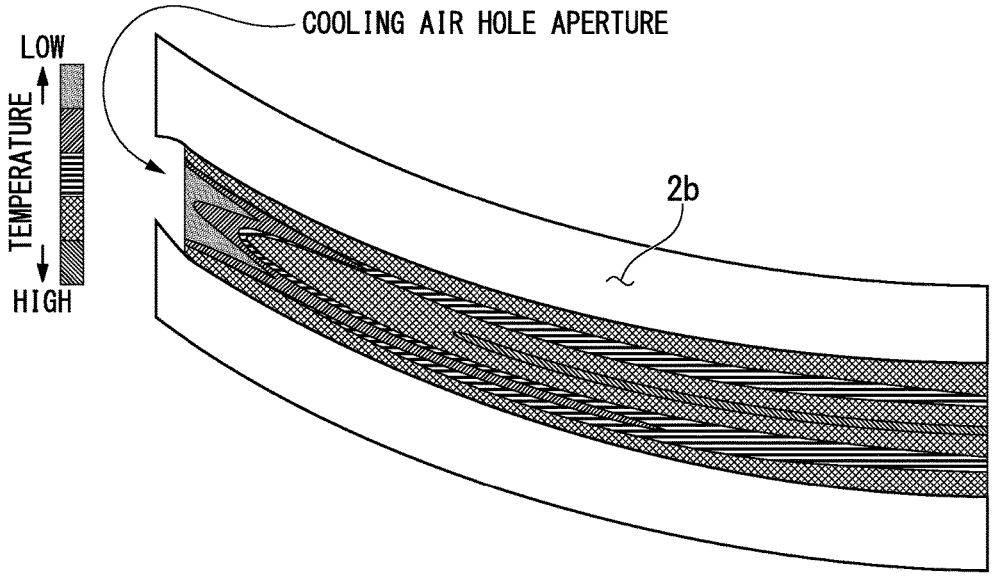
FIG. 4A is a view showing the results of a simulation of the temperature distribution on an external wall surface using as a model a turbine blade having the guide grooves shown in FIG. 3A through FIG. 3C formed in an expanded portion thereof.
Figure 4B:
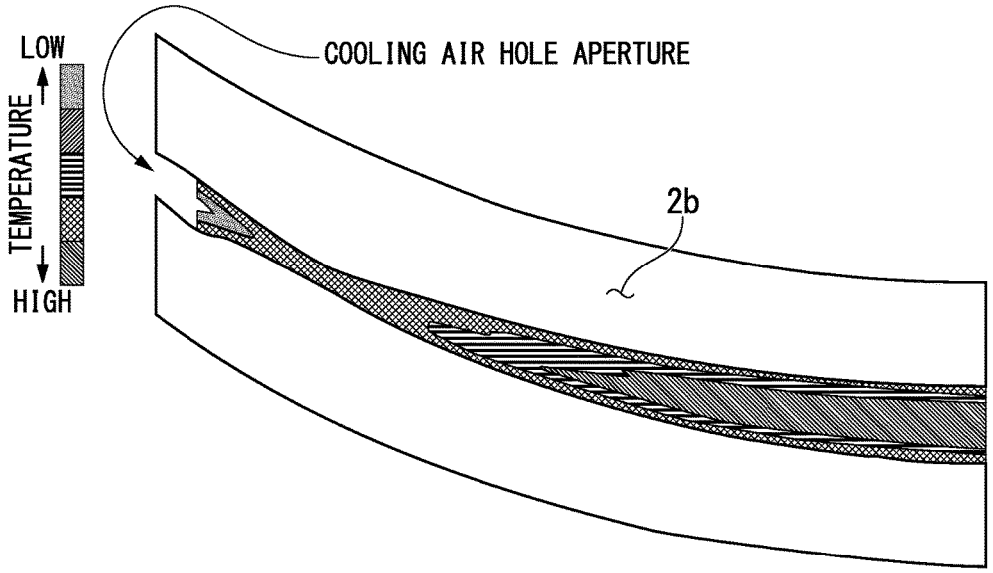
FIG. 4B is a view showing the results of a simulation of the temperature distribution on the external wall surface using as a model a turbine blade in which the guide grooves are not formed in the expanded diameter portion.

FIGS. 4A and 4B show the results of a simulation of the temperature distribution on the external wall surface 2*f* using as a model the turbine blade 1 in which the guide grooves 6 shown in FIGS. 3A through 3C are formed in the expanded diameter portion 5*b*, and also the results of the simulation of the temperature distribution on the external wall surface using as a model a turbine blade in which the guide grooves 6 are not formed in the expanded diameter portion 5*b*. FIG. 4A is a temperature distribution graph showing in typical form the results of a simulation of the temperature distribution on the external wall surface 2*f* using as a model the turbine blade 1 in which the guide grooves 6 shown in FIGS. 3A through 3C are formed in the expanded diameter portion 5*b*. FIG. 4B is a temperature distribution graph showing in typical form the results of the simulation of the temperature distribution on the external wall surface using as a model a turbine blade in which the guide grooves 6 are not formed in the expanded diameter portion 5*b*.

As is shown in FIGS. 4A and 4B, in the turbine blade 1 in which the guide grooves 6 shown in FIGS. 3A through 3B are formed in the expanded diameter portion 5*b*, it was confirmed that the cooling air Y is blown over a broader range, and that the cooling effectiveness was improved.

Second Embodiment

Figure 5A:
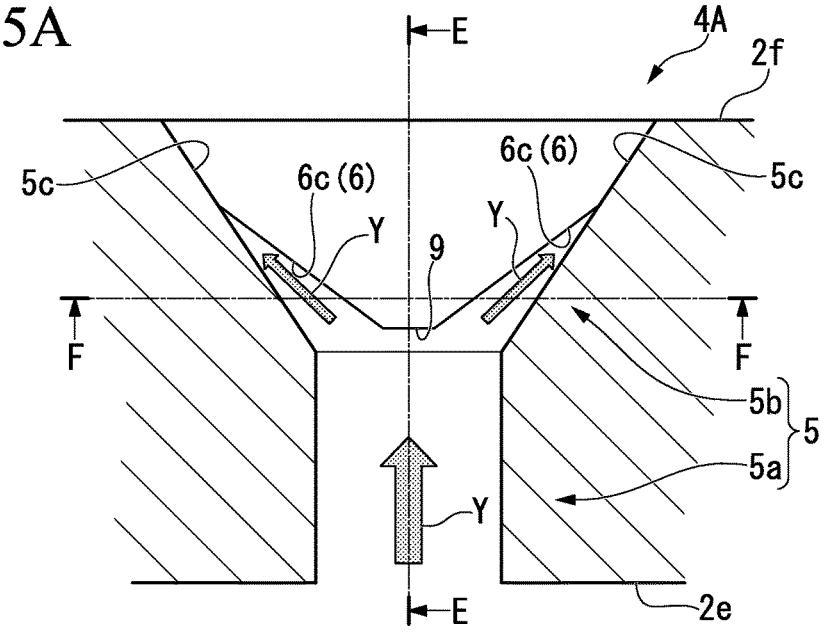
FIG. 5A is a schematic view of film cooling portions provided in a turbine blade according to a second embodiment of the present invention, and is a cross-sectional view taken along a plane that is parallel with the flow direction of cooling air.
Figure 5B:
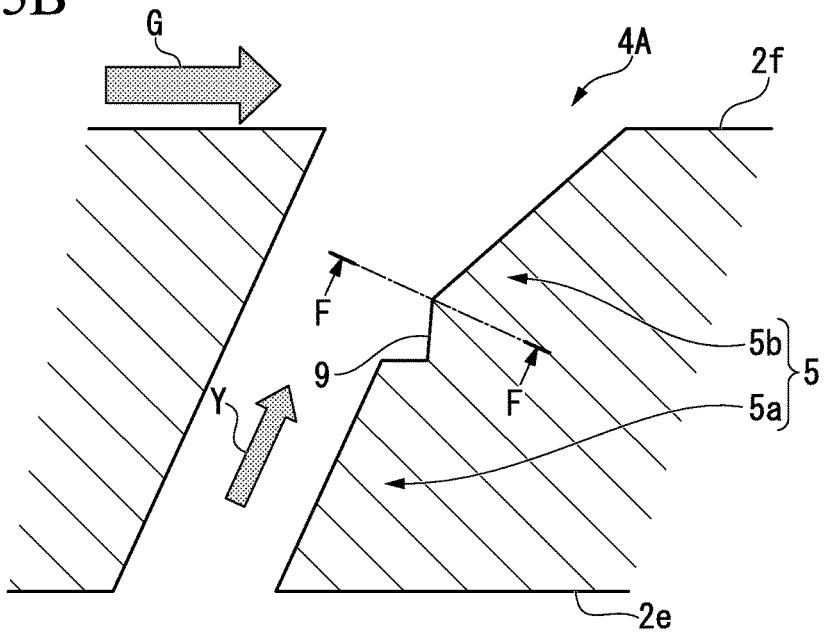
FIG. 5B is a schematic view of the film cooling portions provided in the turbine blade according to the second embodiment of the present invention, and is a cross-sectional view taken along a line A-A in FIG. 5A.
Figure 5C:
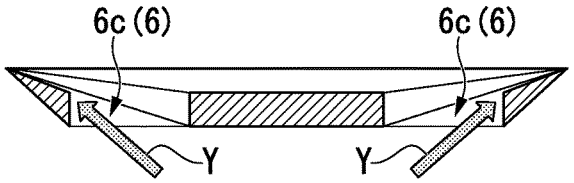
FIG. 5C is a schematic view of the film cooling portions provided in the turbine blade according to the second embodiment of the present invention, and is a cross-sectional view taken along a line B-B in FIG. 5A.

FIGS. 5A through 5C are schematic views of a film cooling portion 4A that is provided in the turbine blade of the present embodiment. FIG. 5A is a cross-sectional view taken along a plane that is parallel with the flow direction of cooling air, FIG. 5B is a cross-sectional view taken along a line E-E in FIG. 5A, and FIG. 5C is a cross-sectional view taken along a line F-F in FIG. 5A.

As is shown in FIGS. 5A through 5C, the film cooling portion 4A of the present embodiment is provided with side guide grooves 6*c* that serve as the guide grooves 6. End portions on the external wall surface 2*f* side of these side guide grooves 6*c* are tapered at a sharp angle. Moreover, the turbine blade of the present embodiment is not provided with the center guide groove 6*b* between the side guide grooves 6*c*, but is provided with a collision surface 9 at the location of the junction between the side guide grooves 6*c*.

In a turbine blade having this type of structure as well, the side guide grooves 6*c* make it possible to spread the air expelled from the cooling air holes 5 over a broader range in the height direction of the blade body 2. Moreover, the collision surface 9 makes it possible to reduce the flow speed of the cooling air Y that is flowing along the expanded diameter portion 5*b*, so that the cooling air Y can be spread over a broader range.

Third Embodiment

Figure 6A:
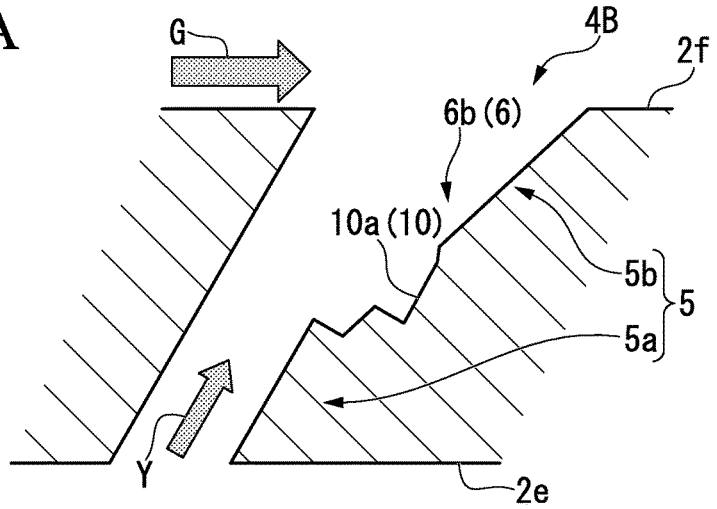
FIG. 6A is a typical cross-sectional view of the film cooling portions provided in the turbine blade according to the second embodiment of the present invention, and shows a first aspect of the film cooling portion of the present embodiment.
Figure 6B:
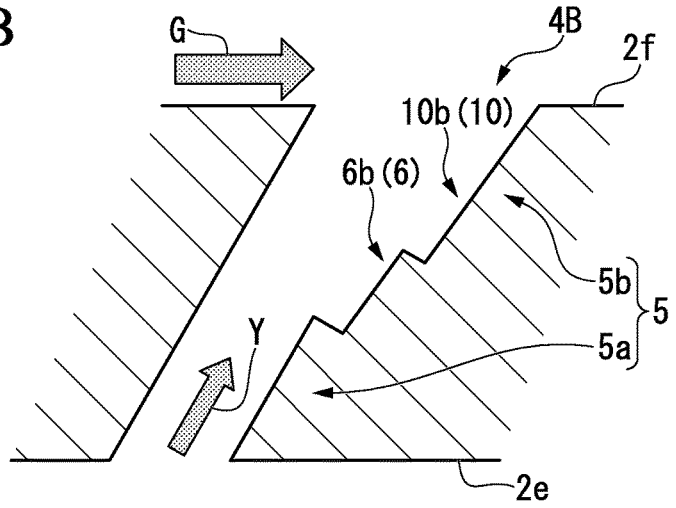
FIG. 6B is a typical cross-sectional view of the film cooling portions provided in the turbine blade according to the second embodiment of the present invention, and shows a second aspect of the film cooling portion.
Figure 6C:
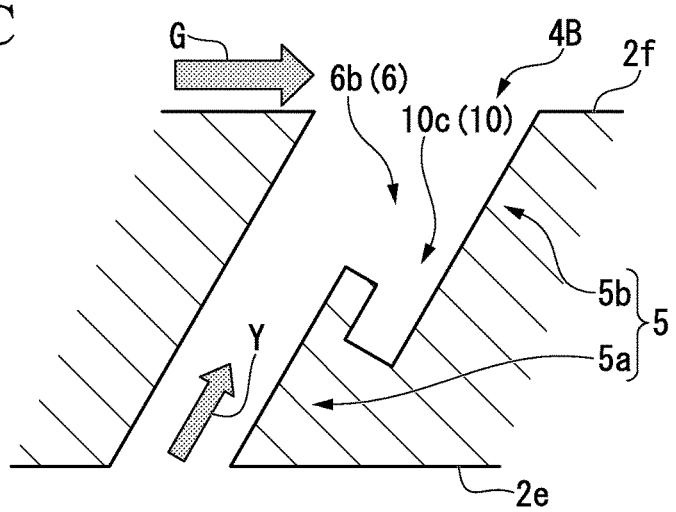
FIG. 6C is a typical cross-sectional view of the film cooling portions provided in the turbine blade according to the second embodiment of the present invention, and shows a third aspect of the film cooling portion.

FIGS. 6A through 6C are typical cross-sectional views of a film cooling portion 4B that is provided in the turbine blade of the present embodiment. FIG. 6A shows a first aspect of the film cooling portion 4B of the present embodiment, FIG. 6B shows a second aspect of the film cooling portion 4B, and FIG. 6C shows a third aspect of the film cooling portion 4B.

As is shown in FIGS. 6A through 6C, in the film cooling portion 4B of the present embodiment, a recessed portion 10 is provided in the guide groove 6. As is shown in FIG. 6A, this recessed portion 10 may take the form of a dimple-shaped cavity 10*a*, or as is shown in FIG. 6B, the recessed portion 10 may take the form of a groove 10*b* that is formed by cutting out a further step in the guide groove 6, or as is shown in FIG. 6C, the recessed portion 10 may take the form of a hole portion 10*c* that is formed by cutting a hollow portion toward the internal wall surface 2*e*.

By providing this recessed portion 10, it is possible to create a vortex in the recessed portion 10 so as to increase the pressure loss. As a result of this, it is possible to reduce the flow speed of the cooling air Y in the guide groove 6, so that the cooling air Y can be spread over a broader range.

Fourth Embodiment

Figure 7A:
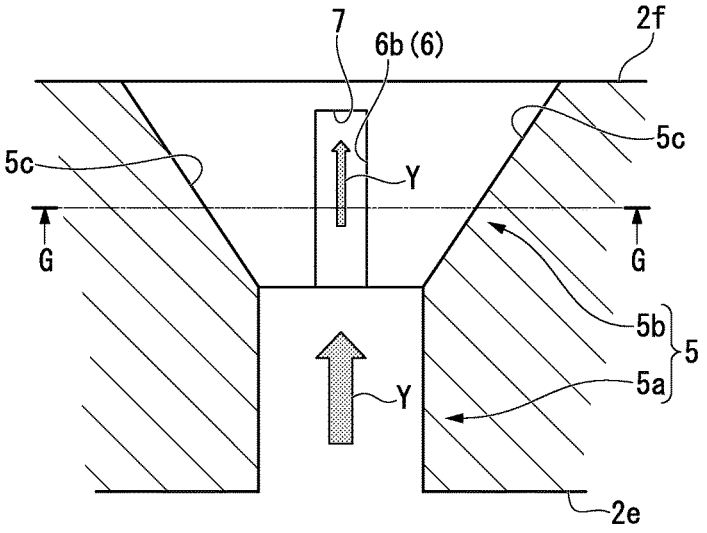
FIG. 7A is a schematic view of film cooling portions provided in a turbine blade according to a third embodiment of the present invention, and is a cross-sectional view taken along a plane that is parallel with the flow direction of cooling air.
Figure 7B:
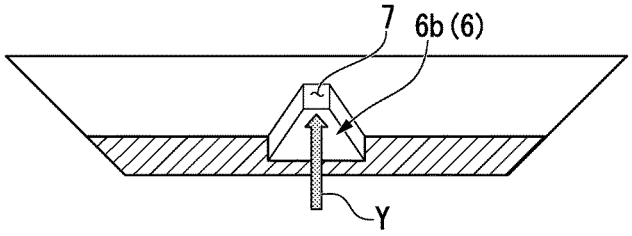
FIG. 7B is a schematic view of the film cooling portions provided in the turbine blade according to the third embodiment of the present invention, and is a cross-sectional view taken along a line G-G in FIG. 7A.

FIGS. 7A and 7B are schematic views of a film cooling portion 4C that is provided in the turbine blade of the present embodiment. FIG. 7A is a cross-sectional view taken along a plane that is parallel with the flow direction of the cooling air Y, while FIG. 7B is a cross-sectional view taken along a line G-G in FIG. 7A.

As is shown in FIGS. 7A and 7B, the film cooling portion 4C of the present embodiment is provided with only the center guide groove 6*b* as the guide groove 6. According to this turbine blade of the present embodiment, even if unevenness is generated in the flow quantity distribution of the cooling air Y inside the straight tube portion 5*a* due to unforeseen factors so that the flow quantity in the center portion is reduced, it is still possible to increase the flow quantity in the center portion of the expanded diameter portion 5*b*, and the cooling air Y can be expelled evenly.

Note that in the present embodiment, it is also possible for a recessed portion 10*b* such as that illustrated in the above-described second embodiment to be provided in the center guide groove 6*b*.

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as limited by the foregoing description and is only limited by the scope of the appended claims.

For example, the placement positions and numbers of the film cooling portions 4 in the blade body 2 of the above-described embodiments are merely one example thereof and may be suitably altered in accordance with the cooling performance required of the turbine blade.

Moreover, in the above-described embodiment a structure in which the turbine blade is a stationary blade is described. However, the present invention is not limited to this, and structures in which the film cooling portion is provided for a moving blade are not excluded.

INDUSTRIAL APPLICABILITY

According to the present invention, cooling air holes are provided with an expanded diameter portion that is located in an external wall surface of a blade body. Because of this, cooling air that has flowed into a straight tube portion spreads out in the expanded diameter portion. As a consequence, according to the cooling air holes of the present invention, cooling air can be blown over a wider range, and a greater range of the external wall surface of the blade body can be cooled compared to when the cooling air holes are formed solely by a straight tube portion.

DESCRIPTION OF THE REFERENCE NUMERALS

1 . . . Turbine blade, 2 . . . Blade body, 2*a* . . . Front edge, 2*b* . . . Rear edge, 2*c* . . . Positive pressure surface, 2*d* . . . Negative pressure surface, 2*e* . . . Internal wall surface, 2*f* . . . External wall surface, 3 . . . Band portions, 4, 4A, 4B, 4C . . . Film cooling portions, 5 . . . Cooling air holes, 5*a* . . . Straight tube portion, 5*b* . . . Expanded diameter portion, 5*c* . . . Side wall surfaces, 6 . . . Guide groove, 6*a* . . . Side guide grooves, 6*b* . . . Center guide groove, 6*c* . . . Side guide grooves, 7, 8, 9 . . . Impact surfaces, 10 . . . Recessed portion, 10*a* . . . Cavity, 10*b* . . . Groove portion, 10*c* . . . Hole portion, G . . . Combustion gas (Main flow gas), Y . . . Cooling air

What is claimed is:

1. A turbine blade having a hollow blade body comprising:

cooling air holes that penetrate the blade body from an internal wall surface to an external wall surface thereof, and are provided with a straight tube portion that is located on the internal wall surface side of the blade body, and an expanded diameter portion that is located on the external wall surface side of the blade body;

a guide groove that is provided on a part of an internal wall of the expanded diameter portion and that guides cooling air in the expanded diameter portion, the part of the internal wall of the expanded diameter portion being located on a downstream side in a flow direction of main flow gas that flows along the external wall surface; and a recessed portion that is provided in the guide groove.

2. The turbine blade according to claim 1, wherein the guide groove is provided extending along an internal wall surface of the expanded diameter portion.

3. The turbine blade according to claim 1, wherein the guide groove is provided extending in the flow direction of the cooling air flowing through the straight tube portion.

4. The turbine blade according to claim 1, wherein the guide groove has a collision surface that is provided in the expanded diameter portion and intersects the flow direction of the cooling air.

* * * * *